US012006657B2

(12) United States Patent
Yilit

(10) Patent No.: US 12,006,657 B2
(45) Date of Patent: Jun. 11, 2024

(54) PIPE LAYING PLOW

(71) Applicant: Michael S. Yilit, Conneaut, OH (US)

(72) Inventor: Michael S. Yilit, Conneaut, OH (US)

( * ) Notice: Subject to any disclaimer, the term of this patent is extended or adjusted under 35 U.S.C. 154(b) by 0 days.

(21) Appl. No.: 17/919,706

(22) PCT Filed: Apr. 28, 2020

(86) PCT No.: PCT/US2020/030161
§ 371 (c)(1),
(2) Date: Oct. 18, 2022

(87) PCT Pub. No.: WO2021/221606
PCT Pub. Date: Nov. 4, 2021

(65) Prior Publication Data

US 2023/0160175 A1 May 25, 2023

(51) Int. Cl.
*E02F 5/10* (2006.01)
*E02F 5/14* (2006.01)

(52) U.S. Cl.
CPC ..... *E02F 5/102* (2013.01); *E02F 5/14* (2013.01)

(58) Field of Classification Search
CPC ... H02G 1/10; H02G 1/06; E02F 5/106; E02F 5/104; E02F 5/00; E02F 5/02; E02F 5/027; E02F 5/10; E02F 5/102; E02F 5/12; E02F 5/14; E02F 5/30; E02F 5/32; E02F 3/00; E02F 3/04; E02F 3/627; E02F 9/00; E02F 9/006; E02F 9/08; E02F 9/14; E02F 9/28; E02F 9/2808; E02F 9/2858; E02F 9/2875; F16L 1/20
See application file for complete search history.

(56) References Cited

U.S. PATENT DOCUMENTS 178,231 A * 6/1876 Campbell ..... E02F 5/102 37/906
716,378 A * 12/1902 Chapman ..... E02F 5/027 37/367
843,386 A * 2/1907 Benson ..... E02F 5/027 37/378

(Continued)

FOREIGN PATENT DOCUMENTS

DE 39160 5/1965
GB 230535 3/1925

(Continued)

*Primary Examiner* — Edwin J Toledo-Duran
(74) *Attorney, Agent, or Firm* — Dwight A. Stauffer

(57) ABSTRACT

A pipe laying plow (100), for operating by moving it forward while pipe (201) is fed therethrough to be laid at a pipe laying depth (D). The plow has a boom (15) held by an above-ground structure (16), and includes a substantially linear pipe feeding tube (3) defining a longitudinal axis (33) in a vertical plane; and a plurality of substantially identically shaped, planar blades (2) attached at regular intervals (BSp) along the tube; a blade length (BL) line intersecting the longitudinal axis (33) at an attachment angle (B), and blade width (BW) lines extending laterally perpendicular to the longitudinal vertical plane; wherein, when the boom is held in operating position, the tube (3) extends longitudinally downward and rearward at a boom angle relative to ground level, and the blades extend lengthwise downward and forward at a plowing angle (A) relative to ground level.

5 Claims, 6 Drawing Sheets

(56) References Cited

U.S. PATENT DOCUMENTS 1,287,291 A * 12/1918 Gordon ..... A01B 13/14 172/699
1,665,428 A * 4/1928 Wagner ..... E02F 5/027 56/189
1,854,617 A * 4/1932 Maloon ..... E02F 5/102 405/183
2,018,138 A * 10/1935 Le Tourneau ..... E02F 5/027 37/367
2,453,723 A * 11/1948 Palmer ..... E02F 5/027 37/366
2,795,111 A * 6/1957 Richardson ..... E02F 3/60 405/164
2,875,585 A * 3/1959 Little ..... E02F 5/104 405/161
2,992,537 A * 7/1961 Callahan ..... E02F 5/003 405/163
3,339,368 A * 9/1967 Ezoe ..... E02F 5/104 405/164
3,423,946 A * 1/1969 Maclay ..... E02F 5/104 405/164
3,456,450 A * 7/1969 Teichmann ..... F42D 3/06 405/181
3,528,255 A * 9/1970 Blinne ..... E02F 5/102 37/367
3,559,414 A * 2/1971 Pike et al. ..... H02G 1/06 405/181
3,664,141 A * 5/1972 Wyatt ..... E02F 5/102 37/367
3,713,300 A * 1/1973 Ward ..... H02G 1/06 172/40
3,824,798 A * 7/1974 Shiroyama ..... E02F 5/104 405/164
3,898,852 A * 8/1975 Ezoe ..... E02F 5/106 405/164
4,053,998 A * 10/1977 Ezoe ..... E02F 5/102 37/367
4,129,992 A * 12/1978 Carlsson ..... H02G 1/10 405/164
4,142,817 A * 3/1979 Lazure ..... F16L 1/032 37/367
4,245,927 A * 1/1981 Wharton ..... H02G 1/10 405/164
4,312,144 A * 1/1982 Ezoe ..... E02F 5/106 37/367
4,758,116 A * 7/1988 Ezoe ..... E02F 5/102 405/164
4,802,793 A * 2/1989 Grinsted ..... H02G 1/10 405/164
4,871,281 A * 10/1989 Justice ..... E02F 5/10 405/184
4,986,697 A * 1/1991 Lynch ..... E02F 5/104 405/165
5,975,804 A * 11/1999 Bockman ..... E02F 5/14 37/367
6,474,909 B1 * 11/2002 Malek ..... H02G 1/06 37/366
7,101,116 B2 * 9/2006 Hart ..... E02F 5/102 405/164
7,841,802 B2 * 11/2010 Fockersperger, Jr. .. E02F 5/102 405/184
8,814,474 B2 * 8/2014 Bell ..... E02F 5/102 405/181
10,323,383 B2 * 6/2019 Wilson ..... E02F 5/125
10,519,624 B2 * 12/2019 Wilson ..... H02G 1/10
2009/0010716 A1 * 1/2009 Fockersperger, Jr. .. E02F 5/101 405/180
2015/0284932 A1 * 10/2015 Johnson ..... E02F 5/145 405/174

FOREIGN PATENT DOCUMENTS

| | | |
|---|---|---|
| GB | 2027771 | 2/1980 |
| NL | 9301788 | 5/1995 |
| SU | 419682 | 11/1974 |
| WO | 1991003607 | 3/1991 |

* cited by examiner

Forward
Downward
GROUND
201
14
FL
LD
C
31
8
5
51
TOD
10
4
4
100
(100a)
3
B
7
2
1
72
15
6
A
12
Depth Adjust
9
11
4
8
32
35
D
13
16

201
FL
LD
2a
31
ILD
2b
20a
2c
20b
BLD
2d
72
1
2e
301
L
1x
2f
6
1y
35
32
20f
STARTING TRENCH
201
D

+2"
LD
-2"
10
C
-3.6°
+3.7°
A
+3.6°
-3.7°
9
15'
15
Do-DI
D=Do
Do+DI
15"

PIPE LAYING PLOW

CROSS-REFERENCE TO RELATED APPLICATIONS

This application references but does not claim the benefit of priority for U.S. Provisional Patent Application No. 62/811,438, filed Feb. 27, 2019, by the present inventor.

BACKGROUND OF THE INVENTION

The laying of a line of buried pipe (e.g., water or gas lines, drainage tile/pipe, or even cable/conduit, etc.) originally meant trenching, then pipe laying, and then backfilling in a non-continuous process. A variation of this uses spaced apart holes or short trenches and a horizontal drill or pushrod to feed the pipe through the ground between holes. These techniques handle almost any kind of pipe (tile, tubing, conduit, cable, etc.) but they are slow, non-continuous, and labor/machinery intensive.

A faster, continuous process is available using a plough (a.k.a. plow) pulled by a tractor(s), but the present (prior art) plow designs impose significant limitations on the type of pipe it can lay. A cable plow generally uses a thin vertical blade to cut a shallow slit while pressing a relatively thin and flexible cable into it, but the cable must make a right angle turn around a pulley at the bottom back end of the plow blade. This won't work for more rigid piping.

A tiling plow (or other pipe laying plows) is an adaptation of the cable plow where a feed tube behind the blade surrounds the pipe as it passes from an above ground inlet down through the tube to an outlet near the bottom at the depth of pipe laying. Larger diameter pipe requires a larger diameter tube, and drain tile pipe can be 3" to 12" diameter. A blade may be laterally wedged, but this mostly compresses the soil around it to open a trench, and if the blade isn't wedged then the pipe itself must do the job. This becomes much more difficult as trench width increases for larger pipe diameters, particularly for harder soil and deeper laying depths. Thus it becomes necessary to lift/push a significant portion of the soil up out of the trench, i.e., to excavate it ahead of the tube, then backfill after the tube passes. Such continuous excavation is typically done with a vertically inclined lifting shape such as a blade that may be a straight inclined plane or may include scoop-like curved portions. Like a plow, the farthest forward tip of the blade is at the bottom, and the blade angles rearward and upward from there. An alternative multi-blade approach uses multiple scoop/tooth/buckets on a moving chain or wheel (as in a wheel trencher), but this is not a plow and has many additional problems particular to it, including all the extra moving parts and wear surfaces. Particularly for a single plow blade, as laying depth increases, the plow becomes much harder to pull due to the force needed to break up and lift the full depth of dirt all at once. Drain tile is typically laid at a nominal depth of 3 feet, but may be wanted anywhere from 2 to 7 feet deep.

For example, a prior art plow for laying pipe at 5 foot depth required two tractors to pull it, each tractor being 4-wheel drive, 300 HP and weighing 30,000 pounds. The prior art plows generally have a pipe feeding tube attached behind it and extending substantially vertically from a tube inlet above ground to an outlet at the bottom of the plow. This arrangement requires that the pipe must be able to feed through at least one 90 degree bend in the feed tube before laying flat along the bottom of the plowed trench. This is problematic for larger diameter pipes and for more rigid pipes, such as metal instead of plastic. For example, drain tile may be at least 4 inch diameter, so it must be made with flexible plastic material and construction. Even smaller diameter pipe/tile/conduit is limited to flexible materials (e.g., plastic) and construction (e.g., thinner walls, and/or corrugation).

It is an object of the present invention to overcome the prior art limitations to provide a continuous pipe laying device and method that can lay more-rigid pipe, at depths of up to 7 feet (or more), while using much less pulling force. For example, the inventive plow described hereinbelow is expected to only need one 200 HP, 20,000 pound tractor for a 5 foot laying depth comparable to the example described above.

BRIEF SUMMARY OF THE INVENTION

According to the invention, a pipe laying plow (100), for operating by moving it forward while pipe (201) is fed therethrough to be laid at a pipe laying depth (D) is characterized by the plow having a boom held by an above-ground structure (16) having a forward, front end (14), and includes a substantially linear pipe feeding tube defining a longitudinal axis in a vertical plane; and a plurality of substantially identically shaped, planar blades attached at regular intervals (BSp) along the tube; a blade length (BL) line intersecting the longitudinal axis at an attachment angle (B), and blade width (BW) lines extending laterally perpendicular to the longitudinal vertical plane; wherein, when the boom is held in operating position, the tube extends longitudinally downward and rearward at a boom angle relative to ground level, and the blades extend lengthwise downward and forward at a plowing angle (A) relative to ground level.

Further according to the invention, there is a pivot joint between the support structure (16) and the tube near a tube front end (31); and a depth adjustment mechanism (9) attached to the tube for raising or lowering a rear end (32) of the tube thereby pivotingly adjusting the pipe laying depth (D). Preferably a cleanup blade is at the rear end (32) of the tube for lifting soil (301) missed by the plurality of blades.

Further according to the invention, the plow is constructed to pivotingly adjust pipe laying depths D in a depth adjustment range equal to a design center depth (Do) plus or minus a depth adjustment increment (DI), wherein: blade lengths (BL) from bottom edge to top edge are predetermined such that for all depths in the depth adjustment range (Do plus or minus DI): no blades extend below the pivotingly adjusted depth, and a blade lift distance (BLD) is greater than or equal to a lifting depth, where blade lift distance is the vertical component of blade length, and lifting depth is the vertical depth difference between subsequent blade bottom edges. This may also include a cleanup blade at the rear end (32) of the tube for lifting soil (301) missed by the plurality of blades.

In an embodiment of the invention, plow component dimensions are designed such that the lifting depth is less than 10 inches, the boom angle is less than 30 degrees, and the plowing angle (A) is between 33 degrees and 22 degrees when the boom is pivotingly adjusted to pipe laying depths (D) in a range of plus or minus a one-foot depth adjustment increment (DI) about a design center depth (Do).

Further according to the invention, the embodiment may be characterized in that: for a first design center depth (Do) of 3 feet, the plowing angle (A) is about 27.5° at design center, the boom angle is about 11°+/−4°, the blade lift depth is about 6 inches+/−2 inches, the blade attachment angle (B)

is about 38°, and a boom length is about 16 feet. For a second design center depth (Do) of 6 feet, the plowing angle (A) is about 27.5° at design center, the boom angle is about 22°+/−4°, the blade lift depth is about 6 inches+/−1 inches, the blade attachment angle (B) is about 50°, and a boom length is about 16 feet.

Further according to the invention, the plurality of blades may have an inverted variable width profile, wherein the blades have a maximum width (BWt) near a top edge (22) of the blade. In an embodiment, lateral blade edges (23) are shaped to maintain a uniform widthwise separation between the lateral blade edges and components (3, 6, 1) of the boom lying therebetween.

Further according to the invention, a baffle (29) may extend rearward from a top end (22) of the blade for preventing soil (301) lifted by the blade from falling down into a tunnel (20) formed behind the blade.

Further according to the invention, a planar spine (1) in a longitudinal vertical plane may extend downward from the tube between the blades. Optionally, the spine may have a sharpened bottom edge (72) extending between blades near a bottom edge of the blades. Optionally, a tooth (7) may extend beyond a bottom edge (72) of the spine.

Further according to the invention, a spike-like tooth (7) may extend beyond a bottom edge of the blade.

Further according to the invention, a breaker (71) may protrude ahead of, or on the front of, the blade for breaking up lifted soil (301) as it slides up the blade.

Further according to the invention, a longitudinally extended deflector (6) is attached under the tube to establish a wedge for deflecting soil (301) around the tube as the soil is lifted by the blade.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. Or, related but modified elements may have the same number but are distinguished by primes. For example, 299, 299', and 299" are three different versions of an element 299 which are similar or related in some way but are separately referenced for the purpose of describing modifications to the parent element (299). Such relationships, if any, between similar elements in the same or different figures will become apparent throughout the specification, including, if applicable, in the claims and abstract.

Figures 1, 2, 3:
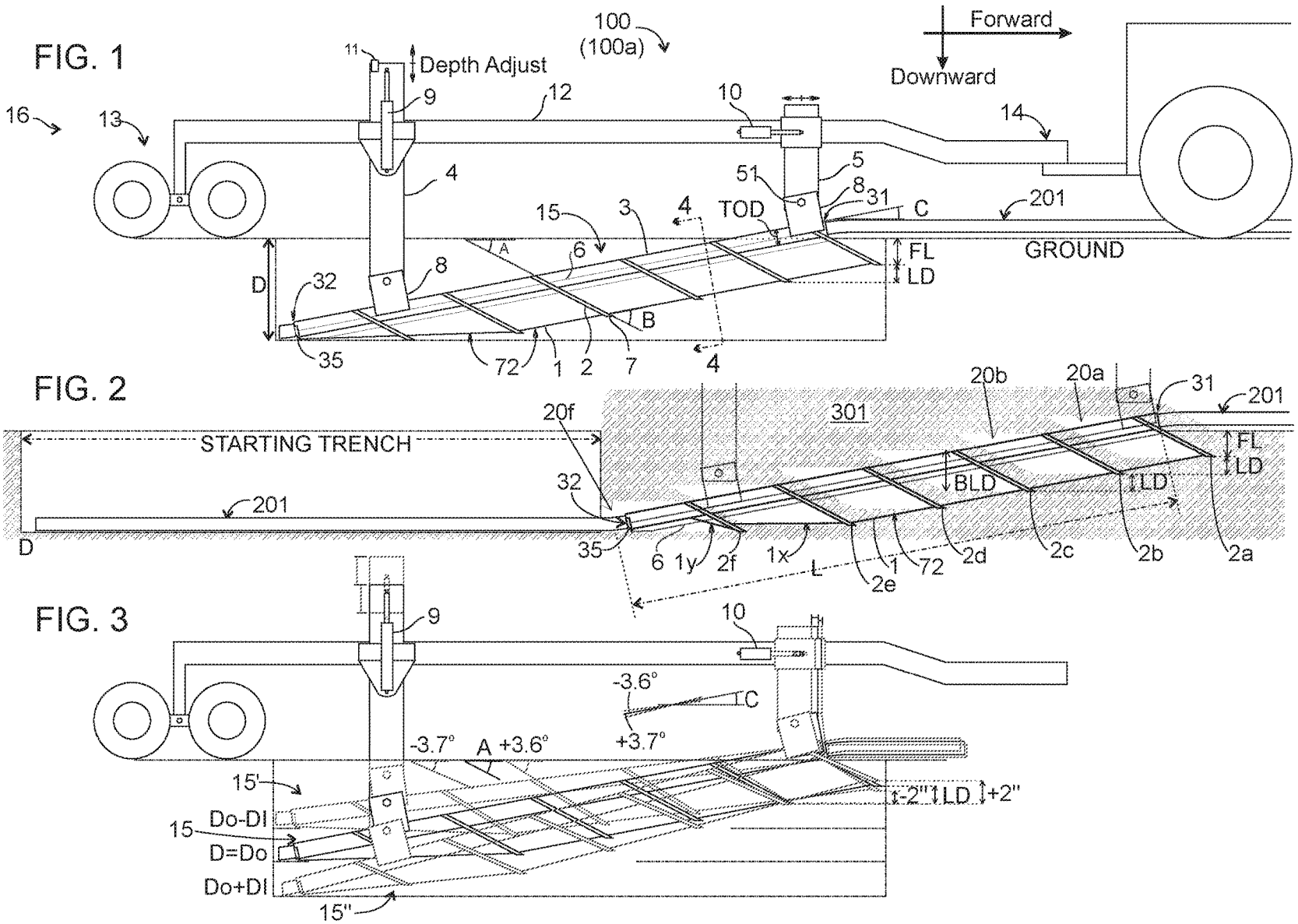

The structure, operation, and advantages of the present preferred embodiment of the invention will become further apparent upon consideration of the following description taken in conjunction with the accompanying drawings, wherein:

FIG. 1 is a side view of a first embodiment of a pipe laying plow with a boom member in a starting trench, where a deflector plate is ghosted and the cross section of dirt outside of the trench is unshaded for clarity, all according to the invention.

FIG. 2 is a side view of the boom of FIG. 1 in operational use after it has been pulled forward underground, shaded to show dirt that has been incrementally broken and lifted to create progressively deeper tunnels, according to the invention.

FIG. 3 is a side view like FIG. 1 but deflectors omitted, showing the effects of pivotingly adjusting to three pipe laying depths, according to the invention.

Figure 4B:
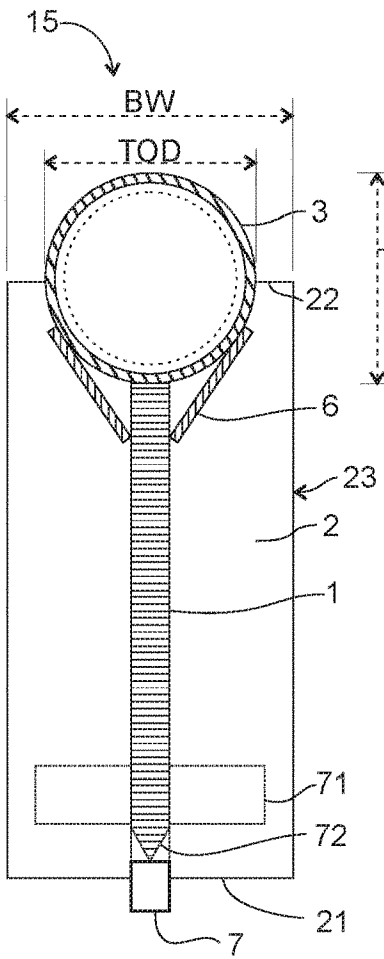
Figure 4A:
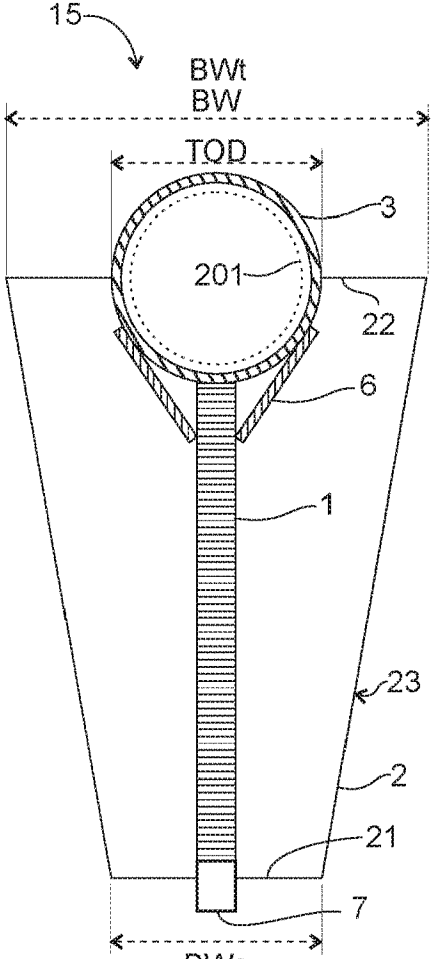

FIGS. 4A-4B are axial cross-section views of boom embodiments showing example blade shapes, the sections taken along the line 4-4 shown in FIG. 1, according to the invention.

Figure 5A:
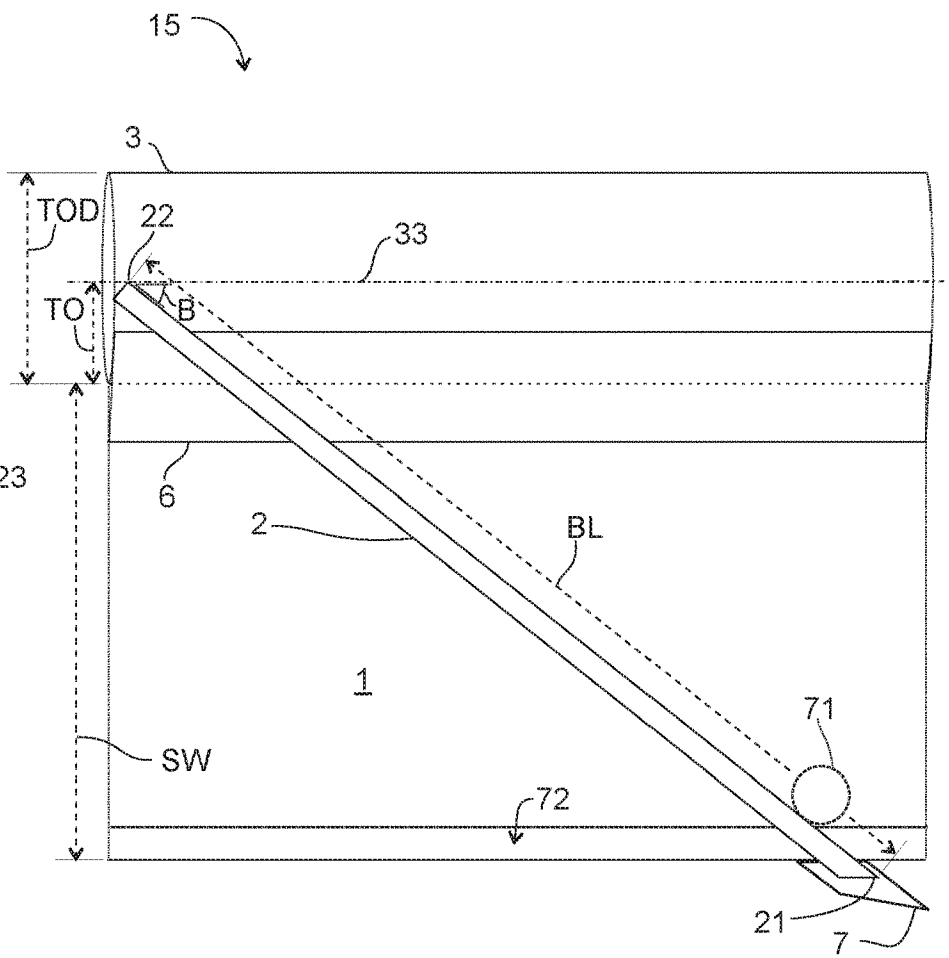

FIG. 5A is a side view of a portion of the boom, the view being in the direction indicated by the arrow 5A in FIG. 4B which is parallel to the longitudinal axis, according to the invention.

Figure 5B:
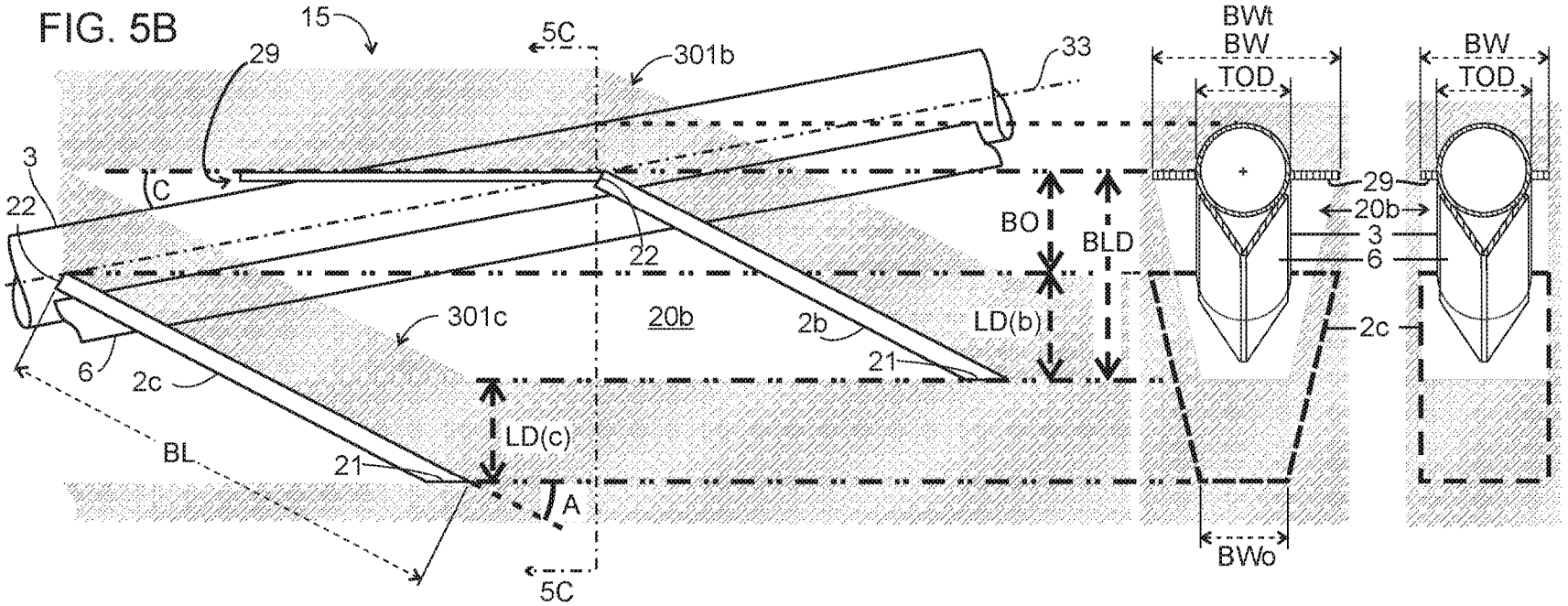

FIG. 5B is a side view of a two blade portion of the boom, in operational use underground with the boom at a boom angle C relative to horizontal, and with spine, tooth, and breaker elements not shown, according to the invention.

FIGS. 5C-5D are cross-section views of the boom, the section taken along the line 5C-5C in FIG. 5B, showing the boom within a tunnel cut into surrounding soil, for two example blade shapes, according to the invention.

Figure 6:
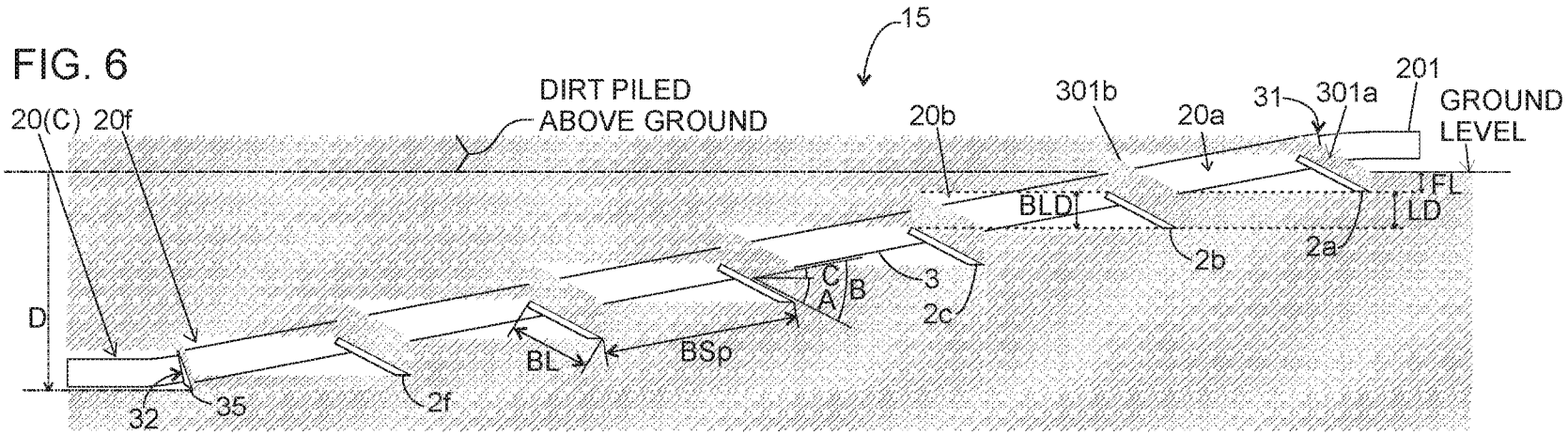

FIG. 6 is the view of FIG. 2 except showing a boom constructed to minimize blade length and simplified by not showing spine, tooth, breaker and deflector elements for the sake of clarity, according to the invention.

Figure 7:
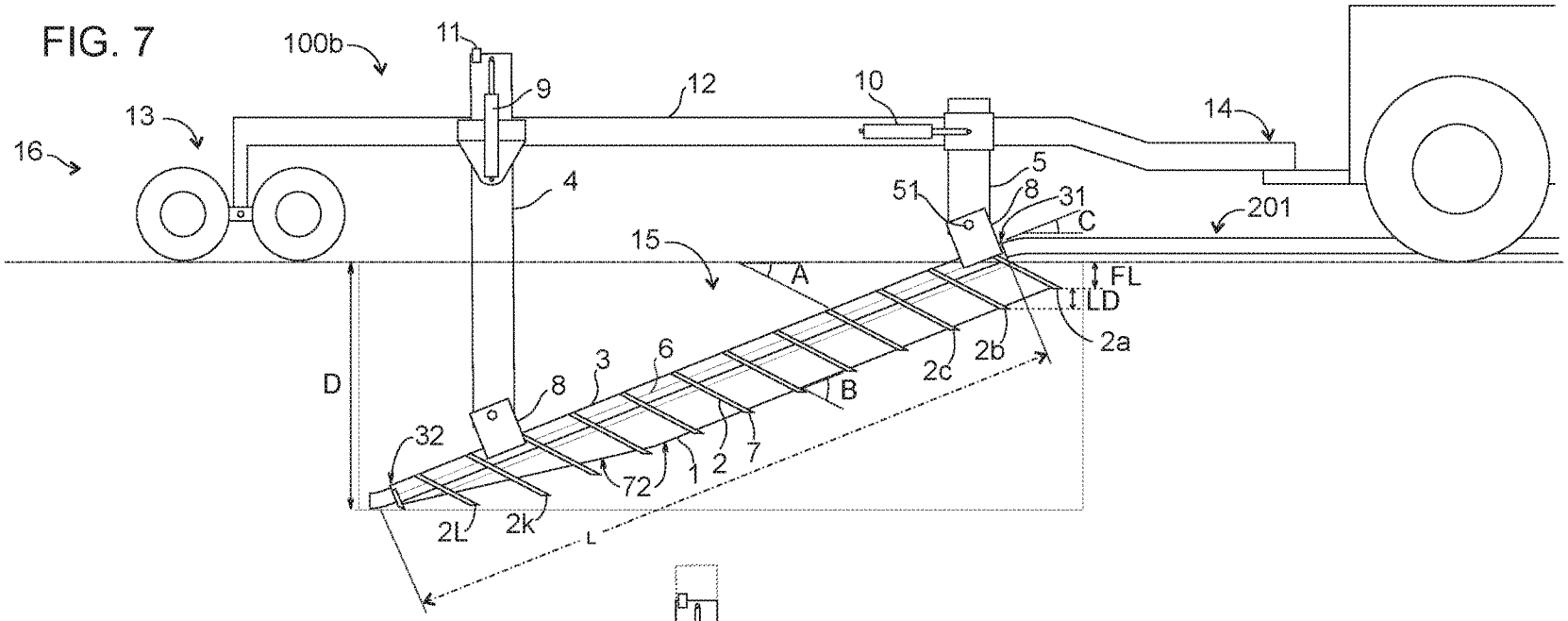

FIG. 7 is a side view of a second embodiment of the pipe laying plow with a boom member in a starting trench, where a deflector plate is ghosted and the cross section of dirt outside of the trench is unshaded for clarity, all according to the invention.

Figure 8:
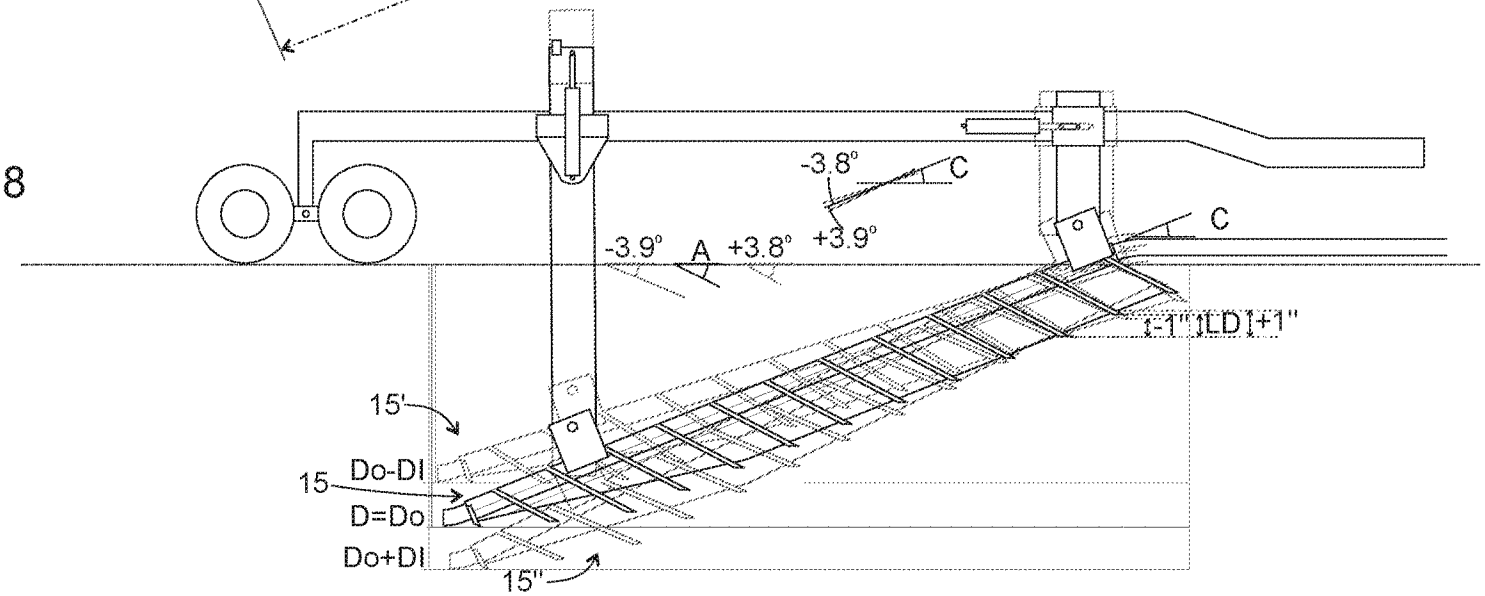

FIG. 8 is a side view like FIG. 7 but deflectors omitted, showing the effects of pivotingly adjusting the second embodiment to three pipe laying depths, according to the invention.

Figure 9:
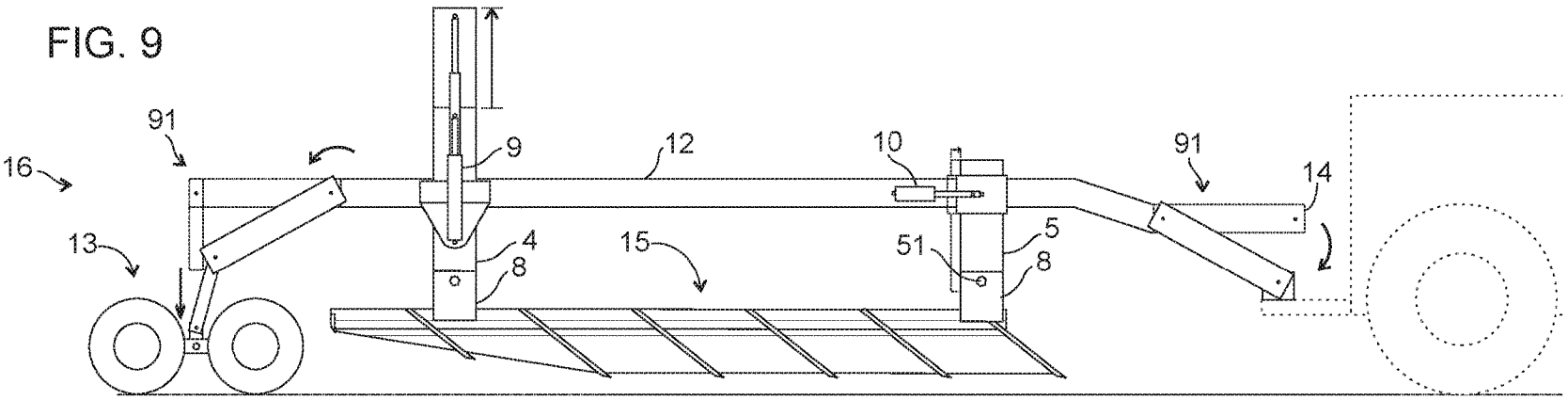

FIG. 9 is a side view of an example way to raise the boom above ground for transporting to/from a work site, according to the invention.

Figure 10:
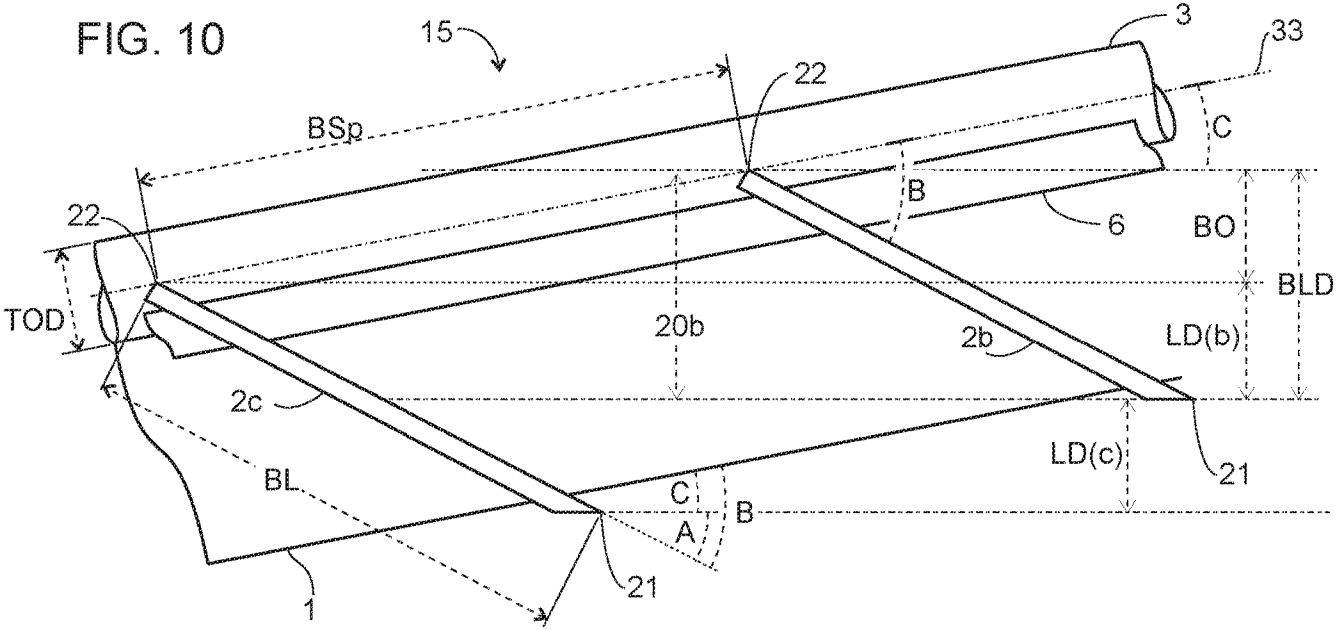

FIG. 10 is a side view of a two-blade portion of a boom embodiment with the boom at a boom angle C relative to horizontal, according to the invention.

Figures 11A, 11B, 11C:
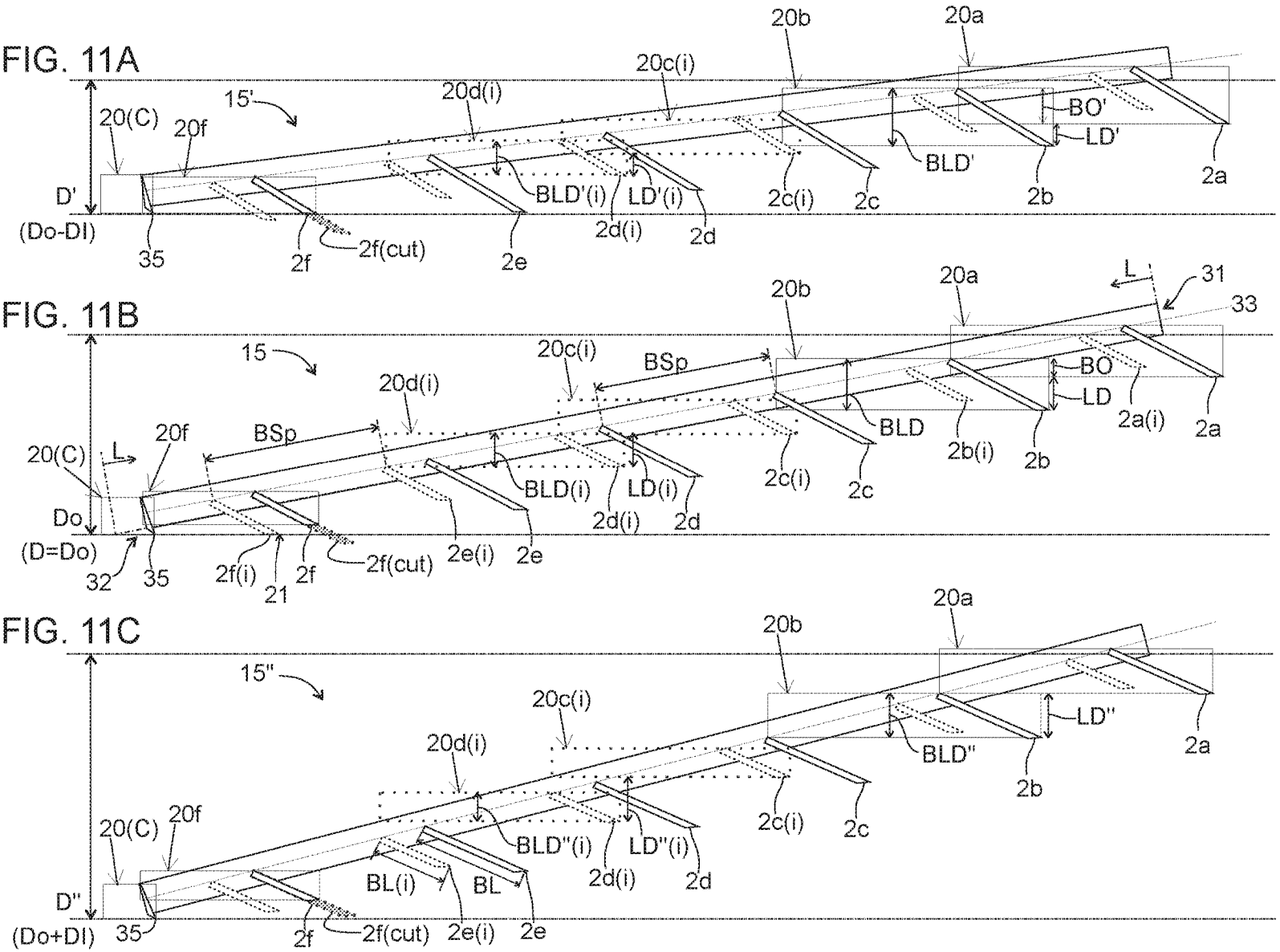

FIGS. 11A-11C are side views of a boom tilted to three boom angles and illustrating a method of design for pivoting depth adjustment, according to the invention.

Figure 12:
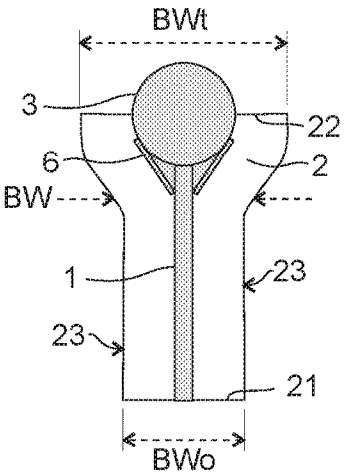

FIG. 12 is an axial cross-section view taken along the line 4-4 shown in FIG. 1, of a boom embodiment showing another example blade shape, according to the invention.

DETAILED DESCRIPTION OF THE INVENTION

The reference numbers and symbols used in the drawings and description are briefly described in the following listing. More details and relationships may be found in the description that follows.

When dimensions are shown, unless stated otherwise, they should be considered as approximate values associated with example embodiment(s) implementing the described inventive principles. For example, an experimental prototype of the inventive plow 100 (first embodiment 100*a*) generally illustrated in FIGS. 1-5, and a second embodiment 100*b* that is illustrated in FIGS. 7-8, had approximate example dimensions shown in parentheses in the provisional application drawings, but they have been removed from the present application's formal drawings, and example dimensions are now reported in the specification. Some of the dimensions are idealized and/or calculated values rather than being actual measurements on a prototype. Dimensions may change as a result of prototype testing and design optimization.

The first embodiment 100*a* (which was assembled for preliminary testing and experimental refining of the design) and the second embodiment 100*b* exemplify two of many possible ways to implement the primary design criteria/parameters such as nominal (design center) values for boom angle C, plowing angle A, blade length BL and lifting depth LD, and secondarily the tradeoff choices of boom length L versus boom angle C at different nominal laying depths Do. Dimensions for the primary design criteria will be held within a relatively narrow range, while others will vary according to judgments about the relative importance in a given application. For example, somewhat larger boom angles C would be acceptable for laying very flexible pipe. For example, soft dirt versus hard packed versus rocky ground may affect the choice of blade shape (e.g., see FIGS. 4A-4B), type and shape of optional tooth 7 and/or breaker 71, and/or magnitude of the lift depth LD, for example.

It may be noted that some plow component dimensions (e.g., those illustrated in FIGS. 4A-5A plus boom length L) are construction related, i.e., fixed when an embodiment is constructed, e.g., by welding together. Other dimensions are usage dependent (e.g., those illustrated in FIGS. 1-3, and 5B-8), being determined by the effect of operating the plow when the boom 15 is tilted to a particular boom angle C as needed to lay pipe at a particular laying depth D. It will be seen that plow performance may be optimized by adjusting the construction related parameters to achieve usage dependent dimensions within predetermined design parameter ranges defined according to the invention.

Glossary Listing

The following list is a glossary of terms and definitions, particularly listing drawing reference numbers or symbols and associated names of elements, dimensions, features and aspects of the invention(s) disclosed herein.

1 . . . Spine; optional longitudinal stiffener/support web for tube 3, blades 2 and deflectors 6 of the boom 15 (which is the digging part of the inventive pipe laying plow 100). May be continuous plate (e.g., 1"×12.5"×L). May be intermittent (serrated) as braces on back side of blades. May have a sharpened lower edge 72.

2 . . . Blade (e.g., plow blade); plurality of blades (2*a*, 2*b* . . . ) affixed at intervals (BSp) along boom 15 for progressively tunneling down to pipe laying depth D, each successive blade breaking up and lifting an incrementally deeper portion of the soil/ground/dirt. The plurality of blades are substantially planar, preferably identically shaped (profile) and dimensioned unless length modification is needed, for example changing the blade length for the last blade before back end of the boom. (e.g., blades made of ½" thick plate cut to blade shape and welded onto the tube and the spine, if present)

20 . . . Tunnel (segments 20*a*, 20*b* . . . ) that is temporarily created behind each blade (2*a*, 2*b* . . . ) as it is pulled forward (e.g., see FIGS. 2, 5B, 6). Each blade lifts dirt up over itself and the tube 3 that follows behind its top end 22, thus using the lifted dirt to at least partly backfill the preceding tunnel segment over the tube. Tunnel height is the blade lifting distance BLD, i.e., the vertical component of the blade length BL when it is used at a particular plowing angle A (slope relative to horizontal).

21 . . . Bottom edge/end of blade 2. May be beveled to knife edge (as shown in FIG. 5A).

22 . . . Top edge/end of blade 2. Located at or above the tube's maximum lateral dimension (e.g., diameter TOD), preferably at the maximum as shown in FIGS. 4A-6 and 10.

23 . . . Lateral blade edges. Shape versus blade length determines blade width profile.

29 . . . Baffle extending rearward from top 22 of a blade 2 for preventing soil lifted by the blade from falling down into tunnel 20 formed behind that blade.

3 . . . Tube; linear pipe feeding tube that protectively surrounds the pipe 201 being laid, and guides it from an aboveground inlet opening end 31 to an outlet opening end 32 at the laying depth D. Round cross-section, preferably circular. Heavy wall steel tube sized to fit around OD of pipe 201. (e.g., ¼" wall tube with 5" ID for feeding nominal 4" pipe~4.5" OD).

31 . . . Aboveground front inlet opening end of the tube 3. Preferably includes forward extended cowling to keep out dirt and/or to funnel pipe into the tube.

32 . . . Outlet opening at bottom/back end of the tube. May include a small cleanup blade 35.

33 . . . Longitudinal axis of the generally linear tube 3; boom axis.

35 . . . Cleanup blade at outlet/rear end of the tube. Used to clear soil that may be left by the last plow blade (e.g., 2*f*). See FIG. 11C.

4 . . . Rear Post; holds the rear end of boom 15 (outlet 32 of tube 3) at pipe laying depth D. Rear post is raised or lowered to adjust the depth of the tube outlet end 32. (e.g., 1"×12" bar)

5 . . . Front Post; holds the front end of boom 15 with inlet 31 of tube 3 at ground level. Hydraulics 10 are used to adjust fore-aft position as needed to compensate for fore-aft movement of boom due to pivotingly raising-lowering, respectively, of the rear end of fixed length boom. (e.g., 1"×12" bar)

51 . . . pivot joint on front post 5 for pivoting boom 15 to raise/lower the rear end while keeping the front end at a fixed elevation (e.g., near ground level). Pivot axis is horizontal-lateral.

6 . . . Deflector(s); longitudinally extended plate(s) attached under the tube 3 below the maximum lateral width (e.g., at diameter TOD) to deflect dirt around the tube as dirt is lifted by the blade 2. (e.g., ¼"×3.5"×L) If no spine 1, then plates are formed together into a downward pointed wedge. Otherwise they are welded to the spine, and preferably to the blade.

7 . . . Tooth; spike-like extension of the blade 2, preferably hardened and chisel-pointed. (see FIGS. 4A-5A) Narrow compared to blade width. Protrudes beyond bottom end 21 of blade (and/or spine edge 72) to function like a "ripper" to break up dense/compacted soil ahead of the blade. One or more teeth may be attached to the blade and/or the spine, if present).

71 . . . Breaker. Optional protrusion (e.g., round bar) on front of blade to help break up hard or rocky soil as it slides up the flat (planar) blade surface.

72 . . . Bottom edge of spine, generally extending between blades near their bottom edge 21. May be beveled to sharp knife edge (see FIGS. 4B, 5A).

8 . . . Mounting Bracket(s); used to pivotingly attach the front and rear posts to the boom.

9 . . . Depth adjustment mechanism, lift cylinder, e.g., hydraulic cylinder. Attached between frame 12 (main support beam) and rear post 4. Used to adjust the pipe laying depth D by raising or lowering the rear end 32 of the tube.

91 . . . Articulating Elements for raising/lowering frame of support structure (optional). See FIG. 9.

10 . . . Fore-aft compensation mechanism, e.g., hydraulic cylinder. Attached between frame 12 and a post 4, 5 (shown on front post 5). Operates as a slave to the Lift Cylinder 9, moving fore-aft to compensate for effect of pivoting the boom as the lift cylinder adjusts laying depth D of boom's rear end. Could be simplified as a passive sliding track. Alternatively could be made into combined mechanism operating on rear post to leave front post fixedly attached to frame.

11 . . . Depth Controller, optionally automated, e.g., using GPS or a laser level to determine absolute elevation of laid pipe in order to maintain a constant slope/gradient independently of ground level or surface unevenness.

12 . . . Frame; Main Support Beam for device 100. Extends between pull hitch 14 and wheel truck/carriage(s) 13 in back. (e.g., 8" I-beam and/or boxed beam). May include articulating elements 91 (e.g., see FIG. 9) suitable for adjusting the support beam elevation, such as for raising the boom 15 above ground level to allow towing transport.

13 . . . Wheel Truck/Carriage(s); rolling ground support, preferably using a walking beam or other structures for averaging out uneven ground, and preferably the wheels are spaced apart left-right to straddle the trench-tunnel and starting trench.

14 . . . Front end Pull Hitch for hitching the device to a tractor(s) or other suitable pulling vehicle. May include a clevis or other suitable hitching/connection means. Optionally add a front wheel truck (not illustrated) at the hitch end of frame such that apparatus is self-supporting and can be pulled like a wagon.

15 . . . Boom (assembly) that is angled down into ground to plow/dig the trench-tunnel. Primarily defined by the pipe feed tube 3 with attached blades 2. Typically also includes spine 1, deflectors 6 and mounting brackets 8. Blades 2 are attached in a layout specific to a plow designed for a nominal design center laying depth Do of, for example, 3 feet (FIG. 1) or 6 feet (FIG. 7) which can then be used optimally for depths within plus/minus a depth adjustment increment DI (e.g., 1 foot). (see FIGS. 3 and 8 showing booms labeled 15 at nominal depth, labeled 15' at nominal minus DI, and labeled 15" (double prime) at nominal plus DI.

16 . . . Support Structure; above-ground components that support and control actions of the boom 15. May include frame 12 with wheel truck(s) 13 and hitch 14, plus front 5 and rear 4 posts with associated brackets 8, mechanisms 9 and 10, pivot 51, and optional articulating elements 91 and controls 11.

100 . . . Pipe Laying Plow. The inventive device overall.
100*a*=nominal 3 ft. design center depth embodiment (particularly see FIGS. 1-3)
100*b*=nominal 6 ft. design center depth embodiment (particularly see FIGS. 7-8)

201 . . . Pipe being laid (e.g., 3" to 12" diameter for drain tile). (e.g., as little as half inch diameter for electrical conduit, gas or water pipes). Pipe may be flexible or rigid conduit, drain "tile", gas or water lines, wire or cable, and the like. Pipe may be laid out on the ground along the planned trench line for simple feeding.

301 . . . Pushed Up Dirt/Soil; underground soil that has been broken up and lifted by the wedging action of a plow blade 2 being pulled forward in operation of the plow 100.

A . . . Plow(ing) Angle; slope of blade 2 relative to ground level (theoretical horizontal) when boom is deployed in ground for pipe laying. Optimum value is 27.5° (degrees) according to the invention. Preferably no more than +/−5° range of variation as pipe laying depth D is changed about the design center/nominal depth Do (e.g., +/−1 ft. depth adjustment increment DI) by varying boom angle C. (Is a Primary Design Parameter.)

B . . . Blade Attachment Angle; Construction parameter specifying angle in the vertical plane between the blade 2 and the longitudinal axis 33 of the boom (tube). Each blade is attached (e.g., welded) to the tube at this angle (e.g., 38.3°) which is calculated to place the blade at an optimum plowing angle A (e.g., 27.5°) when the boom is angled (e.g., C=10.8° or 22°) down to position the bottom outlet end 32 at the nominal (design center) laying depth Do (e.g., 3' or 6').

C . . . Boom Angle; slope of boom 15 longitudinal axis (particularly slope of the pipe feed tube 3) relative to ground level/horizontal. Should be an acute angle, generally less than 45° (degrees), preferably minimized (e.g., less than 30 degrees). It is constrained by practical limits of boom length L, given that sin(C)=D/L. Design center value of angle C occurs when boom is tilted to achieve the design-center (nominal) pipe laying depth Do. The importance of this design parameter is related to rigidity of the pipe 201 being laid (e.g., C=10.8° for rigid and/or large diameter pipe). (Is a Primary Design Parameter.)

D . . . Pipe Laying Depth, set within a range for a given boom design by raising or lowering the rear post 4, while pivoting to maintain a fixed elevation of the front post 5, thereby changing the depth of the outlet end 32 of the pipe feed tube 3 but not the front end 31.

Do . . . Nominal/Design-Center amount of depth D. (e.g., 3 feet or 6 feet). Preferably the plow is designed and constructed for pivotal depth adjustments in a depth adjustment range of +/− a predetermined increment (DI) about the design center depth Do.

DI . . . Depth Adjustment Increment (e.g., +/−1 foot).

L . . . Boom Length (longitudinal); theoretical design length along the bottom of the pipe feed tube 3 from ground level back down to bottom of trench at pipe laying depth D (e.g., see FIGS. 2, 11B). Primarily used to determine blade length, quantity, spacing BSp and first blade position. (e.g., L~16 feet in illustrated embodiments). This construction parameter (component design dimension) determines boom angle C for design center pipe laying depth Do.

BL . . . Blade Length; construction parameter specifying length of the blade 2 from bottom end 21 to top end 22 (at top of tube overlap), e.g., see FIG. 5A or 10. Is a function of blade attachment angle B, where B is set to place the blade at the optimum plowing angle A, and to lift at least a lift depth LD worth of dirt (when the boom is in operating position, i.e., blade lift distance BLD is greater than or equal to LD therefor at the minimum blade length BL the blade overlap BO=zero as shown in FIG. 6.

BLD . . . Blade Lift Distance; vertical component of the blade length BL when boom is in operating position at boom angle C. Equals lift depth LD plus blade overlap BO if any.

Equals height of the tunnel 20 behind the blade (e.g., see FIGS. 2, 5B, 6, 10). Varies with boom angle C BO . . . Blade Overlap; elevation change from a leading blade (e.g., 2*a*) bottom edge 21 up to the top end 22 of the next following blade (e.g., 2*b*). Varies with boom angle C.

BSp . . . Blade Spacing (longitudinal). Construction parameter specifying separation of blades being attached to boom. Preferably determined by LD/sin(C) where LD is the desired lift depth magnitude when the boom is tilted down to a design-center boom angle C.

BW . . . Blade Width. Measured between lateral blade edges 23. The blades 2 are planar and have substantially the same BW dimension(s) and shape (blade width profile). For example, may be constant BW versus length along the blade (e.g., FIG. 4B), or may be tapered from a minimum BWo near bottom 21 of the blade to a maximum width (BWt) near top 22 of blade in the tube overlap portion TO (e.g., FIG. 4A). For example may vary in width to maintain a constant separation between outside edge 23 and central boom structure such as the tube 3, deflector 6 and spine 1 (e.g., FIG. 12). Maximum width must be greater than the diameter (TOD) of the pipe feed tube 3 to allow lifted dirt to pass around the tube i.e., between the tube wall and the trench (tunnel 20) wall established by the lateral edges of the blade, particularly the preceding blade (see FIGS. 5C-5D). (e.g., BW is TOD+2" or more).

BWo . . . Minimum blade width

BWt . . . Maximum blade width

FL . . . First Lift depth, amount of soil broken and lifted by first/leading plow blade (e.g., 2*a*). Determined by elevation change up from bottom 21 of the leading blade to ground level. Note that the bottom of the pipe feed tube 3 should be nominally at ground level at its leading/inlet end 31, (which is preferably shrouded by forward extended housing of the inlet 31 to keep dirt out.) Preferably the first blade 2*a* is positioned to make the first lift depth FL approximately equal to the lift depth LD.

LD . . . Lifting Depth; incremental depth of soil broken and lifted by each subsequent blade (2*b*, . . . 2*c*) after the first blade 2*a*; elevation change from a leading blade's bottom edge 21 down to a following blade's bottom edge 21. (Blades are spaced apart along boom 15 such that each blade will provide a predetermined design center lift depth LD (e.g., about 6") when boom is tilted to place its bottom end 32 at a design center (nominal) pipe laying depth Do (e.g., 3' or 6'). Preferably less than about +/−2" range of variation in LD as depth D is changed (e.g., +/−1 foot) about the design center/nominal depth Do that has been predetermined for a specific boom design (e.g., for plow embodiments 100*a* and 100*b*). (Is a Primary Design Parameter.)

SW . . . Spine Width, measured perpendicular to the tube's longitudinal axis 33. Should be enough to adequately support/hold/stiffen the blade extending below the tube. (e.g., 12.5" as in FIG. 5A)

TOD . . . Tube Outside Diameter; OD of the pipe feeding tube 3. Preferably minimized to have an ID slightly larger than the OD of pipe being fed (e.g., TOD~5.5" for ½" wall tube around a 4.5" OD pipe/drain tile). For non-circular tube profile, TOD represents the maximum lateral width overlapped by the blade (e.g., at edge line 22 as shown in FIGS. 4A-4B). Thus, BW (BWt) minus TOD equals the minimum space through which the soil must pass to be lifted (pushed) over the tube into the tunnel above it.

TO . . . Tube Overlap; amount of the tube 3 that is overlapped by the blade 2 (measured vertically, perpendicular to the tube's longitudinal axis (see FIG. 5A). Is included in blade length BL. Preferably is at least half of TOD.

Embodiments and aspects of the invention will now be described with reference to the drawings using the reference numbers and symbols listed in the above table.

In general, the invention provides a reverse-inclined, multi-bladed pipe-laying plow 100 (e.g., FIGS. 1 and 7) to address the prior art problems with continuously laying pipe 201 at significant depths D such as two to seven feet deep; and doing so with pipe that may be significantly more rigid than before. The invention's apparatus and method improvements of plow-type pipe laying devices yield much better performance (e.g., greatly reduced tractor pulling force requirements) with piping size and laying depths equal to or greater than before.

Referring to FIGS. 2, 5B and 6, the inventive pipe laying method (process) is continuous progressive incremental depth tunneling to lay pipe 201 at the bottom (depth D) of a narrow, vertically straight sided trench-tunnel where only a small top portion 301*a* of the dirt 301 has been lifted above ground level by the first (forwardmost) blade 2*a* which creates a first temporary tunnel 20*a* behind itself, through which the pipe feeding tube 3 is dragged until it reaches the depth of the top edge 22 of the next blade 2*b*, where the next blade 2*b* is lifting dirt 301*b* up over itself and the tube 3 portion that follows behind it, thus using the lifted dirt 301*b* to at least partly backfill the preceding tunnel 20*a* over the tube while simultaneously creating a second temporary tunnel 20*b* that is incrementally deeper (by lifting depth LD) than the previous tunnel 20*a* which is now backfilled above it. In effect, the plow 100 continuously creates and then refills tunnels 20 that are positioned to enable low effort pulling of progressively deeper portions of the tube 3 through temporary tunnels 20 (20*a*, 20*b* . . . ) until the pipe 201 emerges from the bottom, outlet end 32 of the tube to be laid in the bottom-most, outlet tunnel 20(C) at depth D.

Referring particularly to FIGS. 1 and 7 (showing embodiments 100*a* and 100*b*, respectively), the inventive pipe laying method utilizes an inventive plow 100 with a boom 15 in operating position where a pipe feed tube 3 extends downward and rearward at a (preferably small) angle (boom angle C), and a plurality of planar blades 2 (2*a*, 2*b* . . . ) are attached at regular intervals (longitudinal blade spacing BSp, see FIG. 6, 10) along the tube 3, each attached at a blade attachment angle B relative to the boom/tube longitudinal axis 33 which is designed to place the blade 2 at an optimum plowing angle A (e.g., 27.5° forward and downward relative to ground level, i.e., effective horizontal) when the boom/tube is angled down (e.g., boom angle C=10.8° or 22°) to lay pipe 201 exiting the tube's outlet/rear end 32 at a nominal (design center) laying depth D=Do (e.g., 3 feet or 6 feet). The blade spacing BSp is calculated to yield relatively small (e.g., about 6 inch) vertical drops between subsequent blade bottom edges 21, thereby setting a lifting depth LD which is the depth (or height) of dirt that must be broken and lifted by any one of the blades, regardless of the blade's depth below ground level, or the total pipe laying depth D. Note that each blade 2 is lifting dirt into an empty area (tunnel 20) directly above it. For example, see FIGS. 2 and 5B-6.

In preferred embodiments, the plow 100 is designed and constructed to adjust pipe laying depth D by pivoting the boom 15 (changing boom angle C), instead of vertically moving the entire boom without intentionally changing the boom angle (which is the method utilized by prior art tiling plows). Thus, the front post 5 is attached near the front end 31 of the boom 15 by a bracket 8 having a pivot joint 51 with a horizontal-lateral axis, and the post 5 is attached at a fixed elevation to the frame 12 of the aboveground supporting structure 16; and the rear post 4, attached to the boom behind the front post, is attached to the supporting structure 16 in a way that uses a depth adjustment mechanism 9 (e.g., hydraulic cylinder) to adjust the pipe laying depth D by raising or lowering the outlet/rear end 32 of the boom's pipe feed tube 3 while the front post 5 holds the inlet/front end 31 of tube 3 at ground level. Hydraulics 10 may be used to adjust fore-aft position of the front post 5 as needed to compensate for fore-aft movement of boom 15 due to vertically raising-lowering, respectively, the rear end of a fixed length boom.

Note that the herein disclosed pivoting depth adjustment refers to intentional setting of the depth D at which a run of pipe is being laid, wherein the depth D magnitude corresponds to a specific boom angle C. This is not the same as allowing the boom angle to change as the plow digs down to a preset depth.

FIGS. 3 and 8 illustrate examples of pivotingly adjusting pipe laying depth D. It can be seen that the pivoting adjustment changes the blade plowing angle A and therefor the vertical height (BLD) and relative elevation of the tunnels 20 that they create. As further detailed hereinbelow with reference to FIGS. 11A-11C, an inventive design method must be used to determine the blade lengths BL (and their longitudinal positioning) so that the tunnels 20 will at least be adjoining (BLD=LD) or overlapping for all laying depths within an adjustment range of +/−DI about a nominal/design center depth Do. It can be seen that a cleanup blade 35 is used at the rear end 32 of the tube 3 for lifting dirt that may be missed by the plow blades 2, thus assuring a final tunnel 20(C) in which to lay the pipe 201 as it exits the tube outlet 32. Generally speaking the cleanup blade 35 is an arbitrary shape that only extends a short distance below the tube at the rear end 32 to minimize tunnel 20(C) height variation due to boom angle C changes.

This inventive plow compares to prior art trenching plows that have one main blade with a leading bottom blade tip located at the full laying depth (D) such that the entire depth of the trench must be broken up and lifted and/or pushed aside all at once, potentially making a lifting depth of 7 feet. According to research reported in U.S. Pat. No. 4,053,998 (Ezoe, Oct. 18, 1977) the "ditching resistance" (required pulling force) is proportional to the blade width (e.g., BW) times the square of the height of soil (e.g., LD) that is to be simultaneously broken and lifted by a single blade (BW×LD squared). Ezoe addresses this problem by using a plurality of shorter lift depth blades that are progressively more narrow as they are located more deeply. Unlike the present invention, each blade plows out a laterally extending shelf which can be refilled by the dirt lifted then spread laterally by the following deeper and more narrow blade. In addition to a plowing angle, Ezoe's blade lateral sides are generally angled rearward (swept back) for the purpose of pushing dirt laterally outward as it is lifted (therefore his entire blade is not planar, i.e., not in a single plane). Ezoe describes an underwater trencher so the results may not exactly correspond to land based trenching, but they should generally inform. The present invention is better because of the single blade width (or width vs. length profile) that we use for all n blades in the sum for i=1 to n of $((BWi)LD^2)$ resistances vs. Ezoe's greater sum of n different resistances due to a series of different blade widths (BWi being the width of i-th blade) many if not all of which are wider than our blades. Also, Ezoe's trencher leaves an open trench in a wide row of raised broken soil, whereas our tunneling method leaves a filled narrow trench without raising very much subsoil to the surface. It should be noted that the soil height referenced as LD in the above calculation is "height of soil that is to be simultaneously broken and lifted by a blade", which does not count any additional distance that the dirt may be lifted above its original depth (e.g., blade overlap distance BO as illustrated in FIG. 5B). FIG.

FIGS. 4A-5D and 12 illustrate the design factors being considered regarding shape and relative dimensions of the plow blades 2. The blade 2 is substantially planar, and all blades 2 have substantially identical shapes (e.g., width profiles). Preferably all blades 2 have the same blade length BL dimensions, although the last (rear-most) blade (e.g., blade 2*f* in FIGS. 2 and 6; or blade 2L in FIG. 7) may be made shorter to prevent over-digging when the boom is pivoted to change pipe laying depth according to the invention (see design process detailed hereinbelow with reference to FIGS. 11A-11C). The blade 2 may be sharp pointed (e.g., for hard packed soil) or relatively straight across the bottom edge 21. In preferred embodiments the blade 2 is straight sided (lateral edges 23) for a constant blade width (BW) profile, e.g., as in FIG. 4B. It can be seen in FIG. 5D that the amount of soil lifted by the broad bottom must be pushed through a restricted cross-sectional area around the deflectors 6 and tube 3, therefor the blade width BW must be adequately larger than the tube width TOD (e.g., diameter, if round). For example, FIG. 4B illustrates BW of about 1.5 times TOD. Some sources suggest at least twice the tube diameter/width, but benefits of this are counterbalanced by ditching resistance increases in proportion to the blade width BW. As alternative to a constant width blade shape the present invention proposes an inverted variable width profile, where the blade 2 is widest in the upper portion where it goes around the tube 3 (and deflector 6 if present). For example FIGS. 4A and 5C show a trapezoidal blade with a width profile that tapers from a minimum width (BWo) near a bottom 21 of the blade 2 to a maximum width (BWt) near a top 22 of the blade 2 in the tube overlap portion where cross-sectional area is most restricted. The narrow bottom portion lifts less volume (area LD by BW) of unbroken soil, and the top portion has a larger width where the soil must pass between the tube 3 and the trench/tunnel 20 wall established by the lateral edges 23 of the blade 2.

As shown in FIGS. 5B-5C, the third blade 2*c* is lifting dirt within a tunnel 20*b* shaped by the preceding (second) blade 2*b* which is higher (dimension LD). Because the third blade 2*c* is wider than the tunnel 20*b* in front of it, the blade 2*c* will be breaking up a narrow portion of sidewall dirt to add to the volume of dirt being lifted 301*c*.

FIG. 12 illustrates another embodiment of a blade 2 with an inverted variable width profile wherein the lateral blade edges 23 are shaped to maintain a uniform cross sectional area for lifted dirt passage along the blade length BL between the lateral blade edges 23 (tunnel walls) and the center boom structure (e.g., tube 3, deflectors 6, spine 1), thereby avoiding a restricted area.

Regarding ditching resistance, the blade length BL is also a factor, for example due to friction. It may be noted that the example embodiments illustrated in FIGS. 1-5D use a blade with more length than the minimum needed, showing a blade lift distance BLD greater than the lift depth LD by an amount labeled as blade overlap BO.

Compared to the essentially single bladed prior art plows with a substantially vertical pipe feed tube, the invention provides a multi-bladed plow 100 that extends the pipe feed tube 3 at a relatively small acute angle (boom angle C) back and down to the pipe laying depth D, where each subsequent blade 2 is incrementally deeper than the preceding blade, and are sloped at an optimum plowing angle A relative to the horizontal.

The inventive design enables utilizing a small angle of bending curvature (e.g., 10 or 20 degree bends) for the pipe 201 being laid, the pipe bending angle being equivalent to the boom angle C.

The incremental lifting is accomplished by spacing apart (BSp) a plurality of blades 2 along an inclined boom 15 such that each blade lifts a predetermined incremental portion of the total laying depth, the portion being a lifting depth LD amount of dirt below that which is lifted by the preceding blade. According to the invention, a good value for lifting depth LD is about 6" (inches). This significantly reduces the tractor power needed to pull the pipe laying plow 100 (compared to a prior art vertical plowshare that must break up and lift the entire depth D of dirt all at once.)

Another design parameter affecting required tractor power (pulling force) is the plowing angle A of the blades 2, which determines how much lifting must be done per inch of forward plow movement. It should be noted that increasing the angle A increases the vertical acceleration of soil movement in proportion to the tangent of the angle A, an exponentially increasing function, and acceleration requires proportional force supplied by the pulling tractor. According to the inventor's research and experimentation, an optimum plowing angle (A) is about 27.5 degrees from the horizontal. (Note that tan(27.5°)=0.5, that tan(45°)=1.0 and tan(65°)=2.1) By using a plurality of spaced apart blades 2, the desired plowing angle can be attained without needing an excessively long single blade which would need an extended support structure, and which would also need to extend ahead of the feed tube to completely excavate the trench before the feed tube passes through it. (To avoid this the prior art typically lifts dirt only part way up then wedges it laterally while forcing the tube through the broken up dirt remaining in the top part of the trench.)

The small pipe bending angle is accomplished by angling the pipe feed tube 3 down into the ground at the desired small bending angle (which equates to the boom angle/slope C). For example, the embodiment 100*a* (see FIG. 1) achieves a 10.8 degree boom angle C at a design center laying depth Do of 3' (feet) by making the boom length L equal to approximately 16 feet. FIG. 3 shows the effects of adjusting the depth D+/−1 foot for the same boom 15. The variation of angles A and C, and of lift depth LD (shown in the drawing) are within a range that shouldn't cause too much difficulty, but using the same boom embodiment to go as deep as 5 to 7 feet may take the plowing angle A and lift depth LD too far from optimum values, thereby potentially causing problems such as requiring excessive tractor power, and/or it may not work at all unless the blades are made much longer. For example, rotating the boom 15 of the first embodiment 100*a* down to a depth D of 7 feet would rotate the blades to a very shallow plowing angle A of 12.4°, and the lift depth LD would increase to 14" (given a long enough blade). However the first embodiment 100*a* blade length BL (e.g., 27") is not enough to lift that amount of dirt when the blade's plowing angle A is only 12.4° (i.e., the blade lift distance BLD is only 5.7" versus the LD=14" height of dirt that must be lifted). To keep the blade attachment angle B (which is fixed by welding), we would either need to add blades more closely spaced (reducing LD) or extend the blades absurdly long to get enough blade lift distance BLD.

Since the plowing angle A of 12.4° would be too far off from optimum 27.5° anyway, our solution is to use a different design for deeper pipe laying. Therefore a second embodiment 100*b* (see FIGS. 7-8) is used for a design center laying depth Do of 6 feet, intended for laying pipe at depths of about 5 to 7 feet. In this embodiment, the blade attachment angle B is changed so that the design center (nominal) values of plowing angle A (e.g., 27.5°) and lifting depth LD (e.g., 6") are kept for the deeper design center depth Do of 6 feet, but the boom angle C is allowed to increase in order to keep the boom length L at a practical length (e.g., 16 feet). (To keep the angle C at 10.8°, then a 32 foot long boom would be needed.)

For example, if the same boom length L (e.g., 16 feet) is used at a design center laying depth Do of 6 feet, then mathematically the boom angle C increases to about 22° at D=6 feet and about 25.9° at D=7 feet. If this is too much of a bend, then it could be adjusted by varying an appropriate combination of L, A, and LD, plus BL if a longer blade is needed to attain the new lift depth LD.

To summarize, due to the inventive method of changing pipe laying depth D by vertically pivoting the boom 15 about a front end pivot joint 51 that holds the top end at ground level we only need two versions/constructions 100*a* and 100*b* of the pipe laying device 100 to handle a range of pipe laying depths D from 1 foot to 7 feet deep.

Design For Pivoting Depth Adjustment

As mentioned hereinabove with reference to FIGS. 3 and 8, pivoting the boom 15 (varying boom angle C) to change pipe laying depth D, correspondingly pivots the attached blades 2, thereby changing the blades' plowing angle A and consequently also the blade lift distance BLD and the incremental lifting depth LD (and first lift depth FL). The magnitude of these changes (documented in the drawings) is considered acceptable for depth changes of +/−(plus or minus) an increment DI about a design center depth Do (e.g., 3 feet+/−1 foot in FIG. 3, and e.g., 6 feet+/−1 foot in FIG. 8). During design of the plow 100, construction parameters such as boom length L, blade attachment angle B, and blade spacing BSp are determined such that when the boom is pivoted to the design center depth Do, the boom angle C, plowing angle A, and lift depth LD will be at preferred values deemed optimum according to the invention.

FIGS. 11A-11C, which split FIG. 3 apart to more clearly show the boom in each of the three depth adjustment operating positions, show an important additional part of the design process that is necessary to make the inventive pivoting depth adjustment method possible. In particular, the blade length BL and longitudinal positioning along the tube 3 of the whole set of regularly spaced blades (2*a*, 2*b* . . . ) must be adjusted to meet additional criteria as follows: for all depths in the depth adjustment range (Do+/−DI): no blades extend below the pivotingly adjusted depth, and the blade lift distance BLD is greater than or equal to the lifting depth LD, where blade lift distance is the vertical component of blade length, and lifting depth is the vertical depth difference between subsequent blade bottom edges.

An example of this inventive design process is now described with particular reference to FIGS. 11A-11C, which show, respectively: a boom 15' pivoted to the shallowest depth D' (equaling Do−DI); a boom 15 pivoted to the nominal/design center depth Do; and a boom 15" pivoted to the deepest depth D" (equaling Do−DI). For illustrative clarity the boom is simplified to the parts relevant to this design process: tube 3, blades 2, and cleanup blade 35. Rectangles drawn around selected blades illustrate the extent of its blade lift distance BLD which is also the height of the tunnel 20 behind the blade. The lift distance LD is measured from the bottom tip of a blade up to the bottom rectangle line that passes through the preceding blade tip. Blade length dimension is labeled for blades 2*e* and 2*e*(*i*) in FIG. 11B (the Do design center drawing of boom 15).

FIG. 10 shows that the blade attachment angle B is equal to the boom angle C plus the plowing angle A therefor changing the boom angle C has the opposite effect on plowing angle A. This means that FIG. 11A for shallowest depth D' (smallest C) will show the largest blade lift distance BLD' and smallest lift depth LD', while FIG. 11C for deepest depth D" (largest C) will show the smallest blade lift distance BLD" and largest lift depth LD".

The starting point for these drawings is as noted above where the construction parameters have been set such that at design center depth Do, the boom angle C, plowing angle A, and lift depth LD will be at preferred values (design center). The elements labeled with (i) are the result of an initial blade design shown in the Do design center drawing, where the initial design blades 2*a*(*i*)-2*f*(*i*), shown in dashed outline, are given a minimum blade length BL(i) such that the blade lift distance BLD(i) is equal to the (optimum valued) lift depth LD(i) and the set of blades are moved as a group along the axis 33 to position the last blade 2*f*(*i*) with its blade tip 21 exactly at the desired depth Do.

For the next design step we go to the D" deepest drawing (FIG. 11C) where it can be seen that the blade lift distance for the initial blades has decreased to value BLD"(i) while the lift depth has increased to value LD'(i) such that LD'(i)>BLD'(i) which means that there would be a layer of unexcavated soil between tunnels, e.g., as shown between 20*c*(*i*) and 20*d*(*i*). Therefor the blade length is increased enough to make BLD"=LD" (at the deepest depth D") as shown for abutting tunnels 20*a* and 20*b* behind the increased length blades 2*a* and 2*b*. It may be noted that changing blade length BL does not change lift depth LD, although it will change blade overlap BO (or separation if not enough BL). Thus LD"(i)=LD".

Next we need to look at the D' shallowest drawing (FIG. 11A) to see the worst case for blade(s) extending below the intended depth D' (Do−DI) due to maximized blade lift distance BLD'. We see that not only the last of the longer blades 2*f* but the next to last will also extend too far, so the group of blades 2*a*-2*f* is shown after they are repositioned forward along the axis 33 until the next to last blade 2*e* extends down to touch the desired depth D'. Note that the blades are preferably moved as a group to maintain a constant magnitude for blade spacing BSp, and thus to keep lift depth magnitude invariant from blade to blade.

Next, FIG. 11A shows that even after repositioning, the last blade 2*f* is still too long, so we "cut off" the excess length (labeled 2*f*(cut) and illustrated with a dotted outline and shaded fill to highlight the change).

Finally, the last blade tunnel outlines 20*f* show how the (trimmed) last blade 2*f* cannot excavate to the desired depth below the shallowest depth D', therefor a cleanup blade 35 is included at the rear, outlet end of the tube for assuring an outlet tunnel 20(C) is cleared of dirt to leave space for the pipe 201 being laid.

Other Components

As noted above, and as shown in FIGS. 1-5A and 7-10, the prototype embodiment(s) was originally conceived with a generous spine width SW supporting a long blade length BL which yields significant amounts of blade overlap BO. Experimenting with blade shape and with various blade overlaps may fine tune the boom dimensions to values that are optimum for each type of soil, and may be affected by pipe feed tube diameter TOD.

FIG. 6 compared to FIG. 2 illustrates the effect of minimizing blade length BL such that blade overlap BO is zero and therefore blade lift distance BLD is equal to the incremental lift depth LD. As a result, each tunnel 20 is only as high (BLD) as it needs to be to allow passage of the tube 3 through it.

The plow embodiments illustrated in FIGS. 1-5A and 7-10 include a spine 1, however in certain cases such as hard packed/rocky soil a spine 1 may be difficult to pull through the soil, and overly long blades may be too weak unless supported by a spine. As seen in FIG. 2, while the tube 3 generally angles down through the tunnel 20 behind a blade 2, the spine 1 angles down through the dirt below the blade. This may be addressed by, for example, creating a sharp knife edge along the bottom edge 72 of the spine 1 (see FIGS. 4B, 5A), and/or cutting away the part of the spine that protrudes down into the dirt in the LD area ahead of each blade, in effect serrating the spine, e.g., labeled 1*x* as shown ahead of the last blade 2*f* in FIG. 2. Alternatively the serration may leave only a stiffening brace affixed behind a blade, e.g., labeled 1*y* as shown behind the last blade 2*f* in FIG. 2. A potential advantage of a continuous longitudinal spine 1 may be that it would serve as a stabilizing guide to keep the blades plowing in a straight line. Another advantage would be its use as a coulter knife/blade to help in breaking up the soil ahead of a blade.

A spine 1 made of, for example 1"×12" steel plate, provides rigidity and ruggedness as well as a great deal of weight that might be needed to hold the plow boom 15 down at the set depth. For example, the first embodiment 100*a* prototype weighed about 7,000 pounds (including the boom 15 plus the upper support structure 16). Experimentation and design engineering will likely fine tune the weight required and part materials and dimensions such as spine width SW, as needed to implement the design criteria of relatively small LD and an optimum plowing angle A, preferably while minimizing the boom angle C.

Referring particularly to FIGS. 4A-5A, one or more spike-like teeth 7, may be attached to the blade bottom end 21 and/or spine bottom edge 72. It extends beyond the bottom edges to function like a "ripper" to break up dense/compacted soil ahead of the blade. The tooth may be at a different angle than blade, for example extending more horizontally or more vertically to achieve an appropriate ripping point angle of attack. It may be thicker than the blade (e.g., 1" square bar). Tooth tip may be formed by attaching a replaceable "bucket tooth" that may also be hardened. Alternatively the spine edge 72 may be serrated like saw teeth (not illustrated).

As shown in FIGS. 4B-5A, a metal rod or other shape of protrusion ahead of, or on the blade front may be optionally added as a breaker 71 to help break up hard ground as it slides up the flat (planar) blade surface, but this is not preferred. As noted above, one or more teeth 7 may be used for similar purpose, particularly if the tooth is thicker than the blade (as illustrated).

FIG. 9 shows how the boom might be raised above ground level for transporting the plow 100 by towing it on its own wheels 13. For example, a longer extending vertical lift cylinder 9 could be used and/or articulating elements 91 could be used to raise the support beam 12.

As noted above, the first lift depth FL is the amount of soil lifted by the first/leading blade 2*a*. Comparing FIGS. 2 and 7 shows that this decreases when the boom angle C increases, while FIG. 6 shows that shortening the blade length BL also reduces FL. In most soils, the effect of FL magnitude (acting on one blade) is not as important as LD magnitude which is multiplied by all the rest of the blades. Also it may be easier to lift dirt at the surface where it can crumble and move sideways as it is lifted.

FIGS. 2, 5B and 6 show how there may be a problem due to lifted dirt 301 falling down into the tunnel 20 below it. FIG. 5B shows a baffle 29 according to the invention, which is attached above the tube 3 and extending rearward from a top edge 22 of a blade (e.g., the i-th blade 2*i*) such that it can support the soil being pushed up over it to fill in the previous tunnel 20(*i*−1), thus preserving the tunnel 20*i* being created under it by the blade 2*i*.

Although the invention has been illustrated and described in detail in the drawings and foregoing description, the same is to be considered as illustrative and not restrictive in character—it being understood that the embodiments shown and described have been selected as representative examples including presently preferred embodiments plus others indicative of the nature of changes and modifications that come within the spirit of the invention(s) being disclosed and within the scope of invention(s) as claimed in this and any other applications that incorporate relevant portions of the present disclosure for support of those claims.

What is claimed is:

1. A pipe laying plow, for operating use by moving it forward while pipe is fed therethrough from above ground to be laid at a pipe laying depth below ground level, the pipe laying plow characterized by:

a boom held by an above-ground support structure having a forward, front end;

the boom characterized by a substantially linear pipe feeding tube defining a longitudinal axis in a vertical plane; and a plurality of substantially identically shaped, planar blades attached at regular intervals along the tube; a blade length line intersecting the longitudinal axis at a blade attachment angle relative to the longitudinal axis, and blade width lines extending laterally perpendicular to a longitudinal vertical plane;

wherein, when the boom is held in operating position, the tube extends longitudinally downward and rearward at a boom angle relative to ground level, and the blades extend lengthwise downward and forward at a plowing angle relative to ground level;

the pipe laying plow further characterized by:

a pivot joint between the support structure and the tube near a tube front end; and a depth adjustment mechanism attached to the tube for raising or lowering a rear end of the tube thereby pivotingly adjusting the pipe laying depth; and the pipe laying plow being constructed to pivotingly adjust the pipe laying depths in a depth adjustment range equal to a design center depth plus or minus a depth adjustment increment, wherein:

blade lengths from a bottom edge to a top edge are predetermined such that for all pipe laying depths in the depth adjustment range: no blades extend below the pivotingly adjusted pipe laying depth, and a blade lift distance is greater than or equal to a lifting depth, where the blade lift distance is the vertical component of the blade length, and the lifting depth is the vertical depth difference between subsequent blade bottom edges.

2. The pipe laying plow of claim 1, further characterized by:

a cleanup blade at the rear end of the tube for lifting soil missed by the plurality of blades.

3. The pipe laying plow of claim 1, further characterized by:

plow component dimensions designed such that the lifting depth is less than 10 inches, the boom angle is less than 30 degrees, and the plowing angle is between 33 degrees and 22 degrees when the boom is pivotingly adjusted to pipe laying depths in a range of the design center depth plus or minus a one-foot depth adjustment increment.

4. The pipe laying plow of claim 3, further characterized by:

for a first design center depth of 3 feet, the plowing angle is about 27.5° at design center, the boom angle is about 11° plus or minus 4°, the blade lift depth is about 6 inches plus or minus 2 inches, the blade attachment angle is about 38°, and a boom length is about 16 feet measured along a bottom of the pipe feeding tube from ground level back down to a trench bottom at the pipe laying depth.

5. The pipe laying plow of claim 3, further characterized by:

for a second design center depth of 6 feet, the plowing angle is about 27.5° at design center, the boom angle is about 22° plus or minus 4°, the blade lift depth is about 6 inches plus or minus 1 inches, the blade attachment angle is about 50°, and a boom length is about 16 feet measured along a bottom of the pipe feeding tube from ground level back down to a trench bottom at the pipe laying depth.

* * * * *